US007401944B2

(12) United States Patent
Hünerbein et al.

(10) Patent No.: US 7,401,944 B2
(45) Date of Patent: Jul. 22, 2008

(54) OPERATING ROOM LIGHT FIXTURE HAVING TWO LIGHT SOURCES AND A CONTROL UNIT

(75) Inventors: Margret Hünerbein, Lübeck (DE); Ryzard Kummerfeld, Lübeck-Travemünde (DE); Georg Schlör, Sereetz (DE); Joachim Schröter, Lübeck (DE); Ingolf Diez, Tuttlingen (DE)

(73) Assignee: Dräger Medical AG & Co. KGaA, Lübeck (DE)

( * ) Notice: Subject to any disclaimer, the term of this patent is extended or adjusted under 35 U.S.C. 154(b) by 130 days.

(21) Appl. No.: 11/211,033

(22) Filed: Aug. 24, 2005

(65) Prior Publication Data

US 2006/0109650 A1 May 25, 2006

(30) Foreign Application Priority Data

Nov. 19, 2004 (DE) ..... 10 2004 055 839

(51) Int. Cl.
*F21S 10/00* (2006.01)
*F21V 19/02* (2006.01)

(52) U.S. Cl. ..... 362/241; 362/240; 362/247; 362/304; 362/293; 323/905

(58) Field of Classification Search ..... 362/240, 362/241, 247, 304, 2, 293; 323/905
See application file for complete search history.

(56) References Cited

U.S. PATENT DOCUMENTS 2,088,024 A * 7/1937 Baber ..... 362/33
2,356,592 A * 8/1944 Kolbert et al. ..... 362/33
2,715,197 A * 8/1955 Pearlman et al. ..... 315/282
2,884,514 A * 4/1959 Boiteux ..... 307/113
2,896,066 A * 7/1959 Quetin ..... 362/33
3,032,688 A * 5/1962 Spira ..... 315/272
3,107,863 A * 10/1963 Potapenko ..... 362/96
3,147,928 A * 9/1964 Carpenter ..... 362/394
3,328,676 A * 6/1967 Slater ..... 323/327
3,609,335 A * 9/1971 Kelly ..... 362/33
3,928,757 A * 12/1975 Nelson ..... 362/228
4,032,771 A * 6/1977 Ilzig ..... 362/243
4,037,096 A * 7/1977 Brendgord et al. ..... 362/294
4,254,454 A * 3/1981 Hardin, Jr. ..... 362/282
4,651,257 A * 3/1987 Gehly ..... 362/33
5,001,616 A * 3/1991 Gehly et al. ..... 362/308
5,199,785 A * 4/1993 Scholz ..... 362/296
6,135,602 A * 10/2000 Chuang ..... 362/33
6,402,351 B1 6/2002 Borders
6,572,234 B1 * 6/2003 Maier et al. ..... 362/20
6,582,092 B1 6/2003 Marka
7,083,303 B2 * 8/2006 Scholz ..... 362/290
2003/0165055 A1 9/2003 Scholz

* cited by examiner

*Primary Examiner*—Ismael Negron
(74) *Attorney, Agent, or Firm*—McGlew & Tuttle, P.C.

(57) ABSTRACT

An operating room light fixture having a first lighting unit including a first light source and an external reflector, a second lighting unit including a second light source and an internal reflector, and a control unit. The second lighting unit is positioned in front of the first lighting unit with respect to the direction in which the light emerges from the light fixture. The control unit may be actuated by a rotary element located in a handle of the light fixture. A heat reflection filter may be provided for adjusting the color temperature of the light fixture to a desired value.

20 Claims, 4 Drawing Sheets

OPERATING ROOM LIGHT FIXTURE HAVING TWO LIGHT SOURCES AND A CONTROL UNIT

CROSS REFERENCE TO RELATED APPLICATIONS

This application claims the benefit of priority under 35 U.S.C. § 119 of DE10 2004 055 839.6 filed Nov. 19, 2004, the entire contents of which are incorporated herein by reference.

FIELD OF THE INVENTION

The present invention pertains to an operating room light fixture with two lighting units in a lighting fixture housing.

BACKGROUND OF THE INVENTION

An operating room light fixture with two lighting units is known from DE 199 56 337 A1, in which a first lighting unit having a first light source and an external reflector is arranged after a second lighting unit having a second light source and an internal reflector in the direction in which the light emerges. The operating room light fixture has a control unit, which detects the failure of the first lighting unit and switches over to the second lighting unit as a function of a sensor signal. The first lighting unit acting as a main lighting unit is replaced now by the second light unit as a reserve lighting unit because of its defect.

An operating room light fixture with a light fixture housing, in which a lighting unit with a light source is arranged, is known from DE 101 19 215 A1. On the side facing the operating area, the light fixture housing has a handle, by means of which the operator (surgeon) can direct the lighting unit toward the area to be lit in the operating area. The operating room light fixture is fastened to a ceiling of the operating room by means of a suspension in an articulated manner. Operating elements are provided in a wall box fastened to a wall of the operating room for the remote operation of the operating room light fixture, the operating signals being transmitted to the operating room light fixture by means of a transmitter-receiver unit in a wireless manner. The drawback of the prior-art operating room light fixture is the relatively limited operating comfort.

SUMMARY OF THE INVENTION

The object of the present invention is therefore to provide an operating room light fixture in which better illumination of the operating area is guaranteed.

The object is obtained with an operating room light fixture with a first lighting unit having a first light source and an external reflector for generating a surface light and a second lighting unit arranged after the first lighting unit in the direction in which the light emerges. The second light source has an internal reflector for generating an additional in-depth illumination. A control unit is designed to connect the second lighting unit with variable luminous intensity to the first lighting unit.

According to the present invention, the first lighting unit with the first light source and with an external reflector associated with same and the second lighting unit with the second light source and with an internal reflector associated with same are provided. The first lighting unit is used to generate a surface light, while the second lighting unit is used to generate an additional in-depth illumination. As a result, the light advantageously does not have to be bundled to achieve in-depth illumination. A constant light field diameter is always obtained due to the combination of the lighting units The light sources and the reflectors of the lighting units are located on a common optical axis.

According to a variant of the present invention, the first light source of the first lighting unit and the second light source of the second lighting unit can be interconnected such that an optical variable is set according to a preset control curve between a minimum and a maximum by actuating the single operating element.

The special advantage of the device according to the present invention is that two lighting units can be actuated by means of a preset control mode such that illumination of the operating area corresponding to the needs is made possible.

According to a preferred embodiment of the device according to the present invention, the luminous intensity of the operating room light fixture is used as the actuating variable, so that adaptation of the luminous intensity is guaranteed with the combination of at least two lighting units. The in-depth illumination of the operating room light fixture can be optionally improved with the second lighting unit.

According to a variant of the device according to the present invention, the first and second lighting units are superimposed at least in one area of the control curve, which can be used especially to change the in-depth illumination.

According to a variant of the present invention, the operation of the lighting units can be performed by means of a central handle arranged on a side of the operating room light fixture facing the operating area to be lit or by means of a stationarily arranged wall-mounted control unit. The wall-mounted control unit may be connected with the control unit arranged in the light fixture housing of the operating room light fixture in a wireless manner or via a cable.

The operator can set two functions of the operating room light fixture simultaneously by actuating the operating room light fixture at one site. On the one hand, by grasping the handle, the operator can direct the operating room light fixture in space toward the operating area, so that improved illumination of the operating area is guaranteed. On the other hand, the operator can set or adjust the luminous intensity of the light source by operating the control element integrated in the handle, so that optimal illumination of the operating area can be performed relatively simply and rapidly.

According to a preferred embodiment of the present invention, the control element is designed as a rotary element, so that the luminous intensity of the light source can be adapted to the needs by rotation in an easy-to-operate manner.

According to a special embodiment of the present invention, the handle is designed as a sterilizable handle. The control element is advantageously arranged in a central handle, which has a sterile design and thus makes possible the independent operation of the light fixture by the sterile human operator.

According to a variant of the present invention, the control unit is arranged at the light fixture housing, so that the operation of the operating room light fixture, the actuating unit of the operating room light fixture and the lighting unit of the operating room light fixture are arranged in or at a common housing. As a result, the operating room light fixture has a compact design.

Provisions are made according to a variant of the present invention for arranging convergent lenses in the ray path between the light sources and the corresponding reflectors. It is especially advantageous in this connection to use as convergent lenses rotationally symmetrical, annular drum lenses, in the center of which the light source is accommodated. A circular focal cylinder with a plurality of focal points is generated by the drum lens. Especially homogeneous illumination of the operating area is achieved as a result.

According to a variant of the present invention, heat reflection filters are provided at the lighting units in the ray path between the light sources and the reflectors. The heat reflection filter at the second lighting unit, which contains a halogen lamp, additionally has a coating for converting the color temperature into a value in the range of 4,200 K.

An exemplary embodiment of the present invention will be explained in greater detail below on the basis of the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
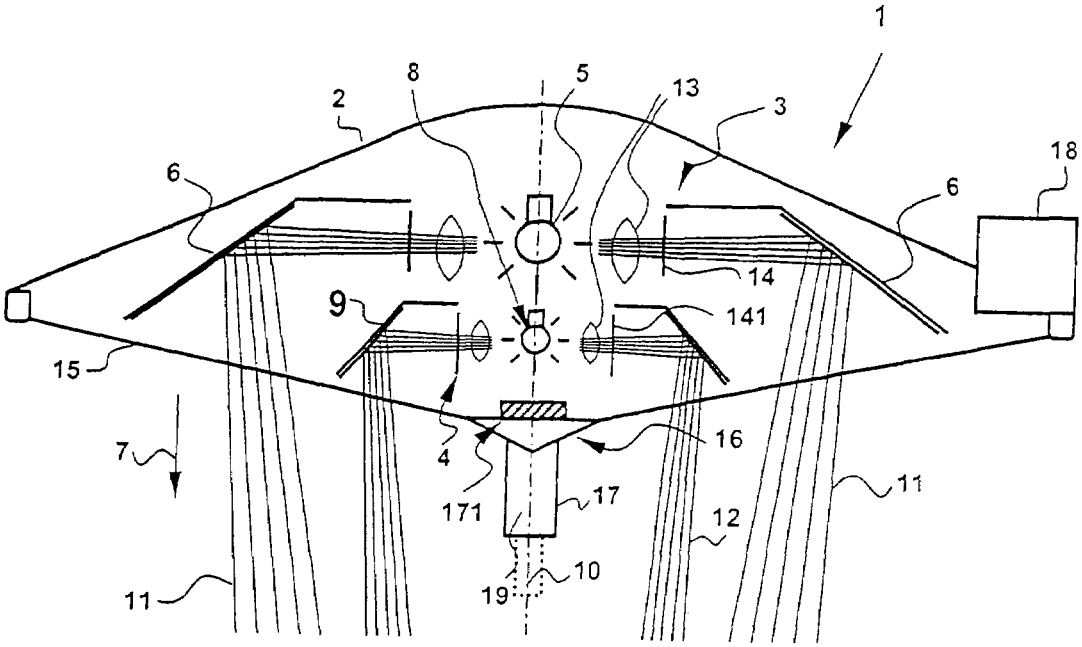
FIG. 1 is a schematic vertical sectional view through an operating room light fixture according to the invention.

Referring to the drawings in particular, an operating room light fixture 1 according to the present invention, which is used, for example, in operating rooms of hospitals, comprises essentially a light fixture housing 2, in which a first lighting unit 3 and a second lighting unit 4 are arranged. The light fixture housing 2 is fastened to a ceiling of the operating room via a suspension, not shown, the adjustment in space of the light fixture housing 2 being guaranteed by pivot bearings of the suspension.

The first lighting unit 3 has a first light source 5 and an external reflector 6 associated with same. The second lighting unit 4 is arranged in front of the first lighting unit 3 in the direction 7 in which the light emerges and has a second light source 8 as well as an internal reflector 9 associated with same.

The first light source 5 and the second light source 8 are arranged on a common optical axis 10 of the operating room light fixture 1. The first light source 5 is designed as a gas discharge lamp and generates a first light bundle 11 for forming a shadowless surface light with a relatively large-area external reflector 6. The second light source 8 is designed as a halogen lamp and generates a second light bundle 12 for forming an additional in-depth illumination in cooperation with the relatively small-area internal reflector 9. A drum lens 13 for guiding light as well as filters 14, 141, which are arranged between the light sources 5, 8 and the reflectors 6, 9, are associated with the light sources 5, 8. The filters 14, 141 are used to absorb the infrared radiation. The filter 141 at the second lighting unit 4 additionally has a coating for converting the color temperature into a value in the range of 4,200 K, preferably 4,200±150 K.

A side 15 of the light fixture housing 2 on which the light emerges is formed essentially by a transparent glass pane. In a central area 16 of the side 15 on which the light emerges, a handle 17 projects downward in the direction 7 in which the light emerges from the side 15 on which the light emerges. The handle 17 is designed as a rotary element (control element) and is used to operate the first lighting unit 3 and the second lighting unit 4. The handle 17 is mounted rotatably around an axis of rotation, which coincides with the optical axis 10. The axis of rotation is directed in parallel to the direction 7 in which the light emerges. The handle 17 is connected with a relative incremental transducer 171, which passes on an electric signal to a control unit 18 of the operating room light fixture 1. A camera 19 may also be optionally installed in the handle 17. The handle 17 is designed such that it can be sterilized and makes possible the direct operation of the lighting units 3, 4 by the operators (surgeon). As a result, direct adjustment (optical adjustment and adjustment in space) of the operating area by the operator is guaranteed.

The incremental transducer 171 may be designed as a stop-free transducer. The incremental transducer 171 may optionally have a mechanical lock for certain angle of rotation ranges.

The control unit 18 is preferably arranged at the light fixture housing 2. As an alternative, it may also be arranged on a suspension, not shown.

Figure 2:
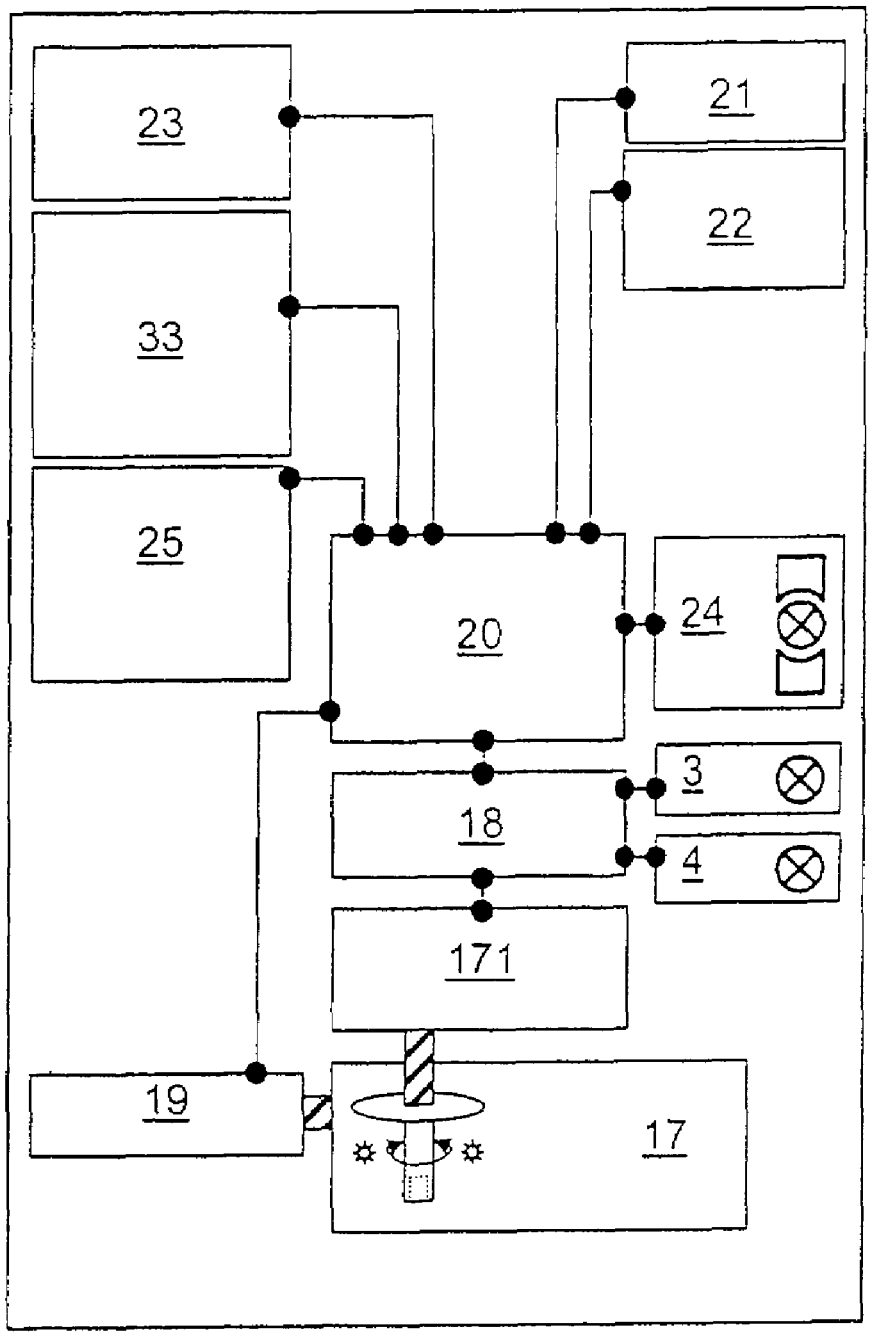
FIG. 2 is a block diagram of the operating room light fixture according to the invention.

As is apparent from FIG. 2, a power supply unit 20, which is preferably fastened directly on the ceiling tube on a side of the suspension facing the ceiling of the operating room, is electrically connected with the control unit 18. The power supply unit 20 makes possible the automatic switching of the power supply of the connected functional units from line-powered operation 21 to an emergency power generator 22 present in the building.

Moreover, the power supply unit 20 may be connected with a stationarily arranged control unit 23. This control unit 23 is preferably fastened to a wall and is used to operate the lighting units 3 and 4 as well as to operate an additional indirect illuminating unit 24, which is arranged on the suspension or on a top side of the light fixture housing 2. This additional illuminating unit 24 generates a diffuse light in order to set a certain basic brightness in the operating room when the lighting units 3, 4 are switched off, without the surgical procedure being hindered. This additional illuminating unit 24 is used for indirect illumination for microinvasive surgery.

The control unit 23 is coupled with the power supply unit 20 via an electric line, which passes on the electric signals to the power supply unit 20 and the control unit 18 via sliding contacts in the hinges of the suspension without stops. The control unit 23 is thus used for nonsterile control just as the control by means of an interface 25 (RS-232 interface) integrated in the power supply unit 20. This interface 25 may be arranged either at the ceiling tube or at an external switch box. It makes possible the coupling of a control unit, not shown, via a USB cable or in a wireless manner by means of infrared radiation. In addition, a wall-mounted control unit 33 may be provided for controlling the camera 19.

The additional illuminating unit 24 can be actuated directly by the power supply unit 20, wherein the first and second lighting units 3 and 4 can be actuated via the control unit 18. The handle 17 is mechanically connected with the incremental transducer 171 and with the camera 19.

Figure 3:
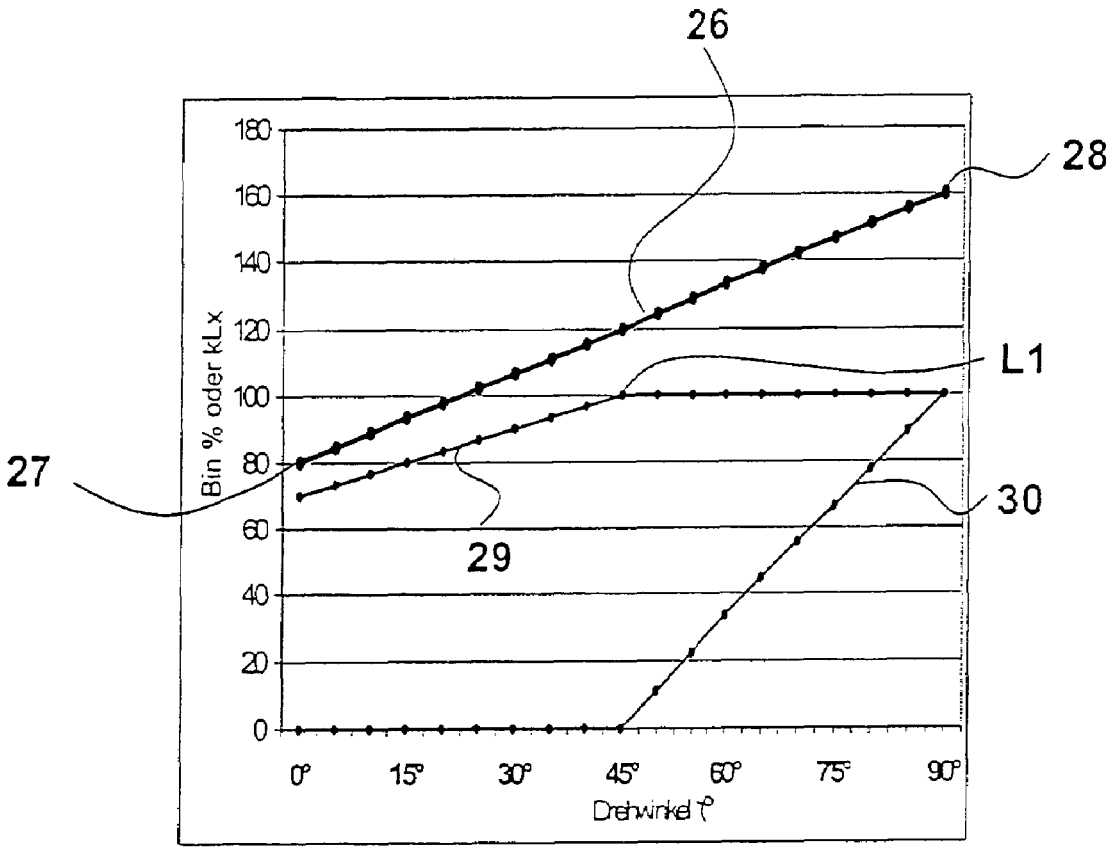
FIG. 3 is a graphic view of a control curve for operating the operating room light fixture.

FIG. 3 shows a control curve 26, according to which the luminous intensity B delivered to the operating area is emitted by the operating room light fixture 1 as a function of an angle of rotation p of the handle 17, 171. The control curve 26 is a total luminous intensity curve that has essentially a linear course and extends from a minimum 27, which corresponds to the angle position $\phi=0°$ to a maximum 28, which corresponds to an angle of rotation value of $\phi=90°$. The total luminous intensity curve or control curve 26 is obtained from a superimposition of the first lighting unit 3 and the second lighting unit 4, wherein only the first lighting unit 3 with its luminous intensity curve 29 contributes to the generation of the resulting total luminous intensity curve or control curve 26 in a first luminous intensity range in an angle of rotation range of $\phi$ between 0° and 45°, i.e., the second lighting unit 4 is switched off. The second lighting unit 4 is superimposed to the first lighting unit 3 in a second luminous intensity range, which extends in an angle of rotation range between $\phi=45°$ and $\phi=90°$, the lighting unit 4 having a linear luminous intensity curve 30, while the luminous intensity curve 29 of the first lighting unit 3 remains constant at 100%. The control curve 26 of the combined lighting units 3, 4 is expressed in kiloLux (kLx). The luminous intensity curves 29, 30 of the first lighting unit 3 and of the second lighting unit 4 are expressed as percentages relative to the nominal luminous intensity of the respective lighting unit 3, 4. The luminous intensity curve 29 rises from 70% to 100% of the maximum luminous intensity in the first illumination range. As a result, the luminous intensity can be adjusted in the first illumination range between 80 kLx and 120 kLx.

The lighting units 3, 4 of the operating room light fixture 1 are controlled as follows: When the operating room light fixture 1 is switched on, the first lighting unit 3 has its maximum luminous intensity value L1. The second lighting unit 4 is switched off. The handle 17 assumes such a position that it corresponds to an angle of rotation of $\phi=45°$. By rotating the handle 17 in a first direction, the luminous intensity 30 of the second lighting unit 4 can be superimposed to the luminous intensity 29 of the first lighting unit 3, angle of rotation range 45° to 90° in FIG. 3. The maximum angle of rotation is 45°. The maximum 28 of the luminous intensity curve 26, at which both lighting units 3 and 4 have reached 100% of their nominal luminous intensities (approx. 160 kLx), is reached in this position.

The handle 17 may be optionally rotated beyond the maximum angle of rotation of 45° in the first direction of rotation, for which case a mechanical lock is provided. Switching is performed in this case in a pure in-depth illumination mode, in which the first lighting unit 3 is dimmed to the extent possible or is switched off.

When the handle 17 is rotated in a second direction of rotation opposite the first direction after switching on the operating room light fixture 1, the overall luminous intensity 26 is determined exclusively by the luminous intensity curve 29 of the first lighting unit 3. The first lighting unit 3 is actuated in this first luminous intensity range such that starting from a switch-on angle 45°, the luminous intensity 29 is reduced in an angle range totaling 45° to approx. 70% of the nominal luminous intensity of the first lighting unit 3. This corresponds to about 80 kLx, the minimum 27 of the total luminous intensity curve 26.

A mechanical lock, which signals to the operator the switching on of the additional illuminating unit 24, may be optionally provided during the further rotation of the handle 17 beyond the angle of rotation range of 45° in the first luminous intensity range. The first lighting unit 3 can be dimmed now, and the radiation from the light fixture housing 2 in the direction of the operating area is very extensively hindered. The illumination takes place in this state of switching essentially by the additional illuminating unit 24. This can be brought about, for example, by moving up the first light source 5, and the light is radiated upward by means of an auxiliary reflector. As an alternative, the emergence of the light radiation in the direction of the operating area can be hindered by covering the first lighting unit in the downward direction.

According to an alternative of the operating room light fixture 1, not shown, the control unit 18 may also actuate the lighting units 3, 4 such that the first illumination range and the second illumination range comprise a different angle of rotation range or more than two illumination ranges are provided. The luminous intensity curves 29, 30 of the lighting units 3, 4 may also be combined such that a nonlinear course of the control curve 26 is obtained. For example, the control unit 18 may actuate the lighting units 3, 4 such that the second lighting unit 4 is switched on additionally already beginning from an angle of rotation $\phi$ at which the first lighting unit 3 has not yet reached its maximum nominal luminous intensity.

As an alternative, other optical variables of the lighting units 3, 4 may also be combined with one another.

As an alternative, the first lighting unit 3 and the second lighting unit 4 may also have light sources 5, 8 of the same type with equal or different nominal power.

Figure 4:
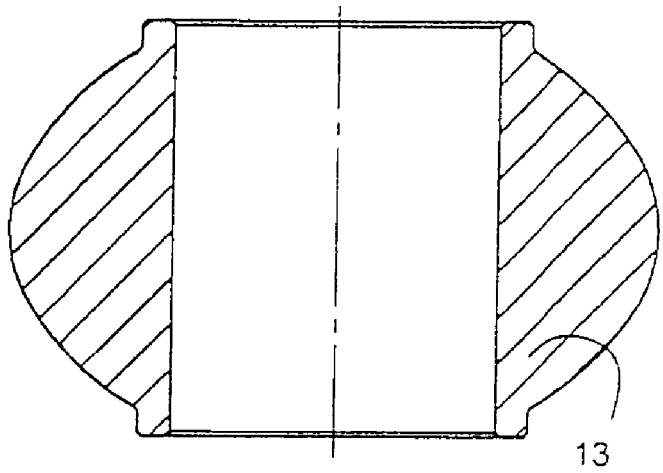
FIG. 4 is a longitudinal section of a drum lens according to the figure.

FIG. 4 shows the longitudinal section of the drum lens 13. The drum lens 13 has an internal diameter of 40 mm, an external diameter of 80 mm and a height of 50 mm.

Figure 5:
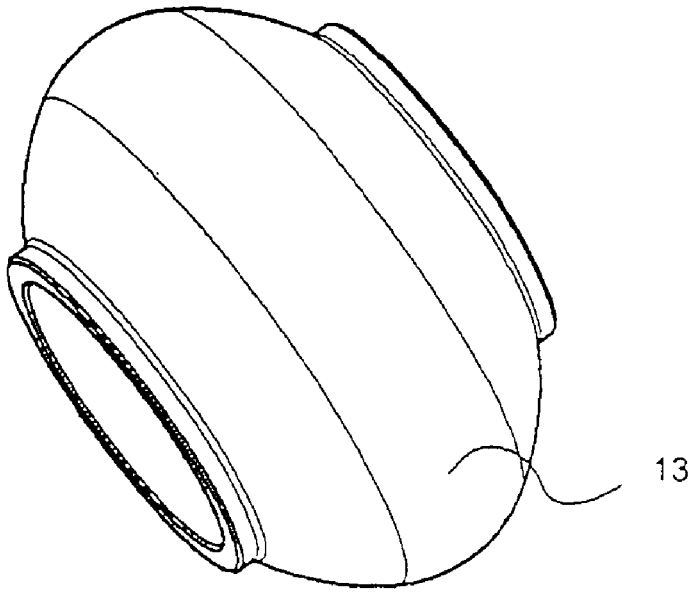
FIG. 5 is a perspective view of the drum lens according to the figure.

A perspective view of the drum lens 13 is shown in FIG. 5.

While a specific embodiment of the invention has been shown and described in detail to illustrate the application of the principles of the invention, it will be understood that the invention may be embodied otherwise without departing from such principles.

What is claimed is:

1. An operating room light fixture comprising:

a light fixture housing having a light emitting side and an axial light emitting direction;

a first lighting unit supported by said light fixture housing and having a radially centrally located first light source and a first lighting unit reflector radially outward of said first light source and directing emitted light axially outwardly for generating an even surface light;

a second lighting unit supported by said light fixture housing, said second lighting unit being arranged axially after said first lighting unit in the axial light emitting direction in which the light emerges, said second lighting unit having a second light source substantially coaxial with said first light source disposed in an axial path between said first light source and said light emitting side and a second lighting unit reflector radially outward of said second light source and radially inward of said first lighting unit reflector and directing emitted light axially outwardly for generating an additional in-depth concentrated illumination;

a control element having a single control actuation range; and a control unit for controlling a luminous intensity of said first light source and said second light source based on a state of said control element with respect to said single control actuation range to provide a preset luminous intensity control curve corresponding to said control actuation range.

2. An operating room light fixture in accordance with claim 1, wherein said control unit is arranged connected to said light fixture housing.

3. An operating room light fixture in accordance with claim 1, wherein said control element is a single control element with a first portion of said control actuation range set via said control unit according to said control unit intensity control curve such that the luminous intensity of said first light source varies from no luminous intensity to a maximum luminous intensity with no luminous intensity of said second source and a second portion of said control actuation range set via said control unit according to said control unit intensity control curve such that the luminous intensity of said second light source varies from no luminous intensity to a maximum with a maximum luminous intensity of said first source, whereby the superposition of said additional in-depth concentrated illumination varies on said even surface light.

4. An operating room light fixture in accordance with claim 3, wherein said control curve set via said control unit represents a linear luminous intensity pattern with a linear variation of a combined luminous intensity of said first light source and said second light source over said control actuation range from zero combined luminous intensity to a combined maximum luminous intensity.

5. An operating room light fixture in accordance with claim 1, wherein said control actuation range is set via said control unit according to said control unit intensity control curve of said control unit such that only said first lighting unit contributes to the total luminous intensity emitted to illuminate the operating area in a first luminous intensity actuation range and said second lighting unit is superimposed to said first lighting unit in a second illumination actuation range.

6. An operating room light fixture in accordance with claim 5, wherein said control actuation range is set via said control unit according to said control unit intensity control curve such that said second lighting unit is connected to said first lighting unit at the beginning of the second luminous intensity range, wherein the luminous intensity of said first lighting unit is constant and the luminous intensity of said second lighting unit is variable in the second luminous intensity range, and the luminous intensity of said second lighting unit is constant and the luminous intensity of said first lighting unit is variable in the first luminous intensity range.

7. An operating room light fixture in accordance with claim 1, wherein said control element comprises a rotary element directly connected to said housing on said said light emitting side and positioned axially after said second lighting unit in the direction in which the light emerges and substantially coaxial with said first light source and said second light source.

8. An operating room light fixture in accordance with claim 7, wherein said rotary element comprises a relative incremental transducer or a potentiometer, which sends an electric signal to said control unit.

9. An operating room light fixture in accordance with claim 1, further comprising:

a first lens in said first lighting unit; and a second lens in said second lighting unit; wherein said lenses are arranged in the ray path between the light sources and the corresponding reflectors.

10. An operating room light fixture in accordance with claim 9, wherein each lens is designed as a drum lens surrounding the respective light source.

11. An operating room light fixture in accordance with claim 1, further comprising heat reflection filters arranged at the lighting units in the ray path between the light sources and the reflectors.

12. An operating room light fixture in accordance with claim 11, wherein said heat reflection filters comprise a heat reflection filter at said second lighting unit has a coating for converting the color temperature into a value in the range of 4,200 K.

13. An operating room light fixture in accordance with claim 1, further comprising:

a handle projecting downward from said light fixture housing, said control element being directly coupled to said handle, or arranged at a stationarily arranged wall mount.

14. An operating room light fixture in accordance with claim 13, wherein said handle comprises a sterilizable handle.

15. An operating room light fixture in accordance with claim 13, wherein said handle is arranged after said first light source of said first lighting unit and in front of said second light source of said second lighting unit in the direction in which the light emerges.

16. An operating room light fixture comprising:

a light fixture housing having a light emitting side and with an axial light emergence direction, said light fixture housing having a central axis extending in said axial light emergence direction;

a first lighting unit supported by said light fixture housing and having a first light source with a first light source axis coaxial with said central axis for emitting light at least radially and a first lighting unit reflector radially outward of said first light source and directing radially emitted light for generating an even surface light directed in said axial light emergence direction;

a second lighting unit supported by said light fixture substantially coaxial with said first light source and in a direct axial path along said central axis after said first light source in said axial light emergence direction for emitting light at least radially and a second lighting unit reflector radially outward of said second light source and radially inward of said first lighting unit reflector and directing radially emitted light axially outwardly for generating an additional in-depth illumination substantially in a direction coaxial with said light emergence direction;

a single control element having a single control actuation range and having a handle for manually changing a state of said control element within said control actuation range, said handle being disposed extending in said axial light emergence direction from said light emitting side and being substantially coaxial with said first light source and said second light source and being in a direct axial path along said central axis after said first light source and after said second light source in said axial light emergence direction; and a control unit linking said second lighting unit with variable luminous intensity to said first lighting unit based on a state of said control element with respect to said control actuation range and a control curve for controlling a luminous intensity of said first light source and said second light source based on a state of said control element with respect to said control actuation range, said control curve being set via said control unit, said control curve having a first curve portion in which said first lighting unit contributes to the total luminous intensity emitted to illuminate the operating area in a first luminous intensity range of said control actuation range and said control curve having a second curve portion in which said second lighting unit is superimposed to said first lighting unit in a second illumination range of said control actuation range.

17. An operating room light fixture in accordance with claim 16, wherein said second lighting unit is superimposed to said first lighting unit at the beginning of the second luminous intensity range, wherein the luminous intensity of said first lighting unit is constant and the luminous intensity of said second lighting unit is variable in the second luminous intensity range, and the luminous intensity of said second lighting unit is constant and the luminous intensity of said first lighting unit is variable in the first luminous intensity range.

18. An operating room light fixture in accordance with claim 17, wherein said control curve set via said control unit represents a linear luminous intensity pattern with a linear variation of a combined luminous intensity of said first light source and said second light source over said control actuation range from zero combined luminous intensity to a combined maximum luminous intensity.

19. An operating room light fixture comprising:

a light fixture housing having a light emitting side and with an axial light emergence direction, said light fixture housing having a central axis extending in said axial light emergence direction;

a first lighting unit supported by said light fixture housing and having a first light source having a first light source axis coaxial with said central axis for emitting light one of radially or radially and axially and a first lighting unit reflector radially outward of said first light source and directing radially emitted light for generating an even surface light directed in said axial light emergence direction;

a second lighting unit supported by said light fixture and arranged after said first lighting unit with respect to said axial light emergence direction, said second lighting unit having a second light source emitting light one of radially or radially and axially and disposed substantially coaxial with said first light source and in a direct axial path along said central axis after said first light source in said axial light emergence direction and a second lighting unit reflector radially outward of said second light source and radially inward of said first lighting unit reflector and directing radially emitted light axially outwardly for generating an additional in-depth illumination substantially in a direction coaxial with said light emergence direction;

a control element having a control actuation range; and a control unit lining said second lighting unit with variable luminous intensity to said first lighting unit based on a state of said control element with respect to said control actuation range and a control curve for controlling a luminous intensity of said first light source and said second light source based on a state of said control element with respect to said control actuation range, said control unit varying the luminous intensity of said first light source from no luminous intensity to a maximum luminous intensity with no luminous intensity of said second light source by movement of said control element in a first portion of said control actuation range and said control unit varying the luminous intensity of said second light source from no luminous intensity to a maximum luminous intensity with a maintained maximum luminous intensity of said first source by movement of said control element in a second portion of said control actuation range to vary the superposition of said additional in-depth concentrated illumination on said even surface light.

20. An operating room light fixture in accordance with claim 19, wherein said control curve set via said control unit represents a linear luminous intensity pattern with a linear variation of a combined luminous intensity of said first light source and said second light source over said control actuation range from zero combined luminous intensity to a combined maximum luminous intensity.

* * * * *